US009253582B2

(12) United States Patent
Nikles et al.

(10) Patent No.: US 9,253,582 B2
(45) Date of Patent: Feb. 2, 2016

(54) ANTENNA DEVICE FOR A HEARING INSTRUMENT AND HEARING INSTRUMENT

(71) Applicant: SIVANTOS PTE. LTD., Singapore (SG)

(72) Inventors: Peter Nikles, Erlangen (DE); Juergen Reithinger, Neunkirchen am Brand (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/596,385

(22) Filed: Jan. 14, 2015

(65) Prior Publication Data

US 2015/0201290 A1 Jul. 16, 2015

(30) Foreign Application Priority Data

Jan. 14, 2014 (DE) ..... 10 2014 200 524

(51) Int. Cl.
*H04R 25/00* (2006.01)

(52) U.S. Cl.
CPC ..... *H04R 25/554* (2013.01); *H04R 25/00* (2013.01); *H04R 25/55* (2013.01); *H04R 25/65* (2013.01); *H04R 25/658* (2013.01); *H04R 2225/023* (2013.01); *H04R 2225/025* (2013.01); *H04R2225/49* (2013.01); *H04R 2225/51* (2013.01); *H04R 2225/67* (2013.01)

(58) Field of Classification Search
CPC .... H04R 25/55; H04R 25/554; H04R 25/604; H04R 25/65; H04R 25/658; H04R 2225/023; H04R 2225/025; H04R 2225/49; H04R 2225/51; H04R 2225/55; H04R 2225/67; H01Q 1/273
USPC ..... 381/23.1, 312, 315, 317, 322, 324, 328, 381/331, 189; 379/52, 443; 343/702, 718, 343/788
See application file for complete search history.

(56) References Cited

U.S. PATENT DOCUMENTS

2008/0226108 A1* 9/2008 Heerlein ..... H04R 25/554 381/324
2010/0195857 A1* 8/2010 Gebhardt ..... H04R 25/554 381/317
2014/0270191 A1 9/2014 Nikles
2014/0363037 A1 12/2014 Nikles
2015/0146900 A1* 5/2015 Vonlanthen ..... H01Q 1/273 381/322

FOREIGN PATENT DOCUMENTS

DE 102013204681 A1 10/2014
WO 2013135307 A1 9/2013

* cited by examiner

*Primary Examiner* — Huyen D Le
(74) *Attorney, Agent, or Firm* — Laurence A. Greenberg; Werner H. Stemer; Ralph E. Locher

(57) ABSTRACT

An antenna device for hearing instruments is particularly suited for ITE hearing instruments to be worn in the auditory canal. The system enables improved data transmission with increased transmission bandwidth with insignificantly increased space and energy requirements. An antenna arrangement with a coil core of magnetically permeable material has a preferred transmit and receive spatial direction. A further electric hearing instrument component emits electromagnetic interference radiation. A partially planar shield of magnetically permeable material is disposed between the antenna arrangement and the further component transversely to the transmit and receive spatial direction of the antenna arrangement and at a distance of 50 to 150 micrometers from the coil core. The distance is optimized to the fact that the signal-to-noise ratio has a maximum around 100 micrometers. The shield effect between antenna and further hearing instrument component initially increases with increasing distance and passes into saturation at about 100 micrometers.

13 Claims, 7 Drawing Sheets

ANTENNA DEVICE FOR A HEARING INSTRUMENT AND HEARING INSTRUMENT

CROSS-REFERENCE TO RELATED APPLICATION

This application claims the priority, under 35 U.S.C. §119, of German application DE 10 2014 200 524.8, filed Jan. 14, 2014; the prior application is herewith incorporated by reference in its entirety.

BACKGROUND OF THE INVENTION

Field of the Invention

The invention relates to an antenna device for hearing instruments, in particular for hearing instruments to be worn in the auditory canal.

Hearing instruments can be embodied, for instance, as hearing devices. A hearing device, also referred to as a hearing aid, is used to supply a hearing-impaired person with acoustic ambient signals which are processed and amplified in order to compensate for or treat the respective hearing impairment. It consists, in principle, of one or more input transducers, a signal processing facility, an amplifier and an output transducer. The input transducer is generally a sound receiver, e.g. a microphone, and/or an electromagnetic receiver, e.g. an induction coil. The output transducer is usually implemented as an electro acoustic converter, e.g. a miniature loudspeaker, or as an electromechanical converter, e.g. a bone conduction earpiece. It is also referred to as an earpiece or receiver. The output transducer generates output signals, which are routed to the ear of the patient and are to generate a hearing perception in the patient. The amplifier is generally integrated into the signal processing facility. Power is supplied to the hearing device by way of a battery that is integrated in the hearing device housing. The essential components of a hearing device are generally arranged on a printed circuit board as a circuit substrate and/or are connected thereto.

Besides hearing devices, hearing instruments can also be embodied as so-called tinnitus maskers. Tinnitus maskers are used to treat tinnitus patients. They generate acoustic output signals which are dependent on the respective hearing impairment and, depending on the working principle, also on ambient noises. The output signals possibly contribute to reducing the perception of distracting tinnitus or other ear noises.

Furthermore, hearing instruments can also be embodied as telephones, cell phones, headsets, earphones, MP3 players or other electronic telecommunication or entertainment systems.

The term hearing instrument is to be understood below both as hearing devices, and also tinnitus maskers, comparable suchlike devices, as well as electronic telecommunication and entertainment systems.

Hearing instruments, in particular hearing devices, are known in various basic types. With ITE hearing devices (In the Ear), a housing containing all functional components including microphone and receiver is worn at least partially in the auditory canal. CIC hearing devices (Completely in the Canal) are similar to ITE hearing devices, but are however worn entirely in the auditory canal. With BTE hearing devices (Behind the Ear), a housing with components such as battery and signal processing facility is worn behind the ear and a flexible sound tube, also referred to as a tube, routes the acoustic output signals of a receiver from the housing to the auditory canal, where an earpiece on the tube is frequently provided to reliably position the tube end in the auditory canal. RIC-BTE hearing devices (Receiver in Canal, Behind the Ear) are similar to BTE hearing devices, but the receiver is nevertheless worn in the auditory canal and instead of a sound tube, a flexible receiver tube routes electrical signals, instead of acoustic signals, to the receiver, which is attached to the front of the receiver tube, in most instances in an earpiece used for reliably positioning within the auditory canal. RIC-BTE hearing devices are frequently used as so-called open-fit devices, in which the auditory canal remains open for the passage of sound and air in order to reduce the distracting occlusion effect.

Deep-fit hearing devices (deep auditory canal hearing devices) are similar to the CIC hearing devices. While CIC hearing devices are however generally worn in a section of the outer auditory canal lying further out (distally), deep-fit hearing devices are moved (proximally) further toward the eardrum and are worn at least partially in the inner-lying section of the outer auditory canal. The outer-lying section of the auditory canal is a canal lined with skin and connects the auricle to the eardrum. In the outer-lying section of the outer auditory canal, which adjoins the auricle directly, this channel is formed from elastic cartilage. The channel from the temporal bone is formed in the inner-lying section of the outer auditory canal and thus consists of bones. The passage of the auditory canal between sections of cartilage and bone is generally angled at a (second) bend and describes a different angle from person to person. In particular, the bony section of the auditory canal is relatively sensitive to pressure and touch. Deep-fit hearing devices are worn at least partly in the sensitive bony section of the auditory canal. On being fed into the bony section of the auditory canal, they must also pass through the mentioned second bend, which may be difficult depending on the angle. Furthermore, small diameters and winding forms of the auditory canal may hamper the advance movement further.

In addition to the hearing device types with an acoustic receiver to be worn on or in the ear, cochlea implants and bone conduction hearing devices (BAHA, Bone Anchored Hearing Aid) are also known.

It is common to all hearing device types that the smallest possible housing or designs are sought in order to increase wearing comfort, if applicable to improve the implant ability and if applicable to reduce the visibility of the hearing device for cosmetic reasons. The drive to identify the smallest possible design likewise applies to most other hearing instruments.

Modern hearing instruments exchange control data by way of a radio system which is usually inductive. The required transmission data rates with binaurally coupled hearing instruments increase significantly if acoustic information is furthermore also to be transmitted for audio logical algorithms (e.g. beamforming, sidelook etc.). A higher data rate requires a larger bandwidth. One of the main determining factors with respect to the sensitivity of the transmission system to interference signals is precisely the bandwidth.

With the high and individual packing density precisely in ITE hearing instruments, hearing-instrument-internal interference signal sources form the main problem. If the bandwidth is increased, this intensifies the problem still further. With typical ITE hearing instruments, the antenna is arranged on or partially in the so-called faceplate (the wall of the hearing instrument facing away from the eardrum). The antenna is then typically in the direct vicinity of the so-called hybrid (hybrid integrated circuit substrate) and of the receiver. The hybrid and the receiver emit magnetic and electric fields, which can have an extreme influence on the transmission.

The arrangement of the antenna relative to the receiver and the hybrid is crucial to the performance of the transmission system. On account of the high packing density, a mutual shielding of the components is required. The hybrid is to this end typically encased with a shield box. The receiver obtains a shield film or is designed especially so that it is magnetically sealed.

The commonly assigned, copending patent application Pub. No. US 2014/0270191 A1 and its counterpart German patent application DE 10 2013 204 681 propose arranging the antenna in the part of the hearing instrument facing the eardrum instead of on the faceplate. A positioning is as a result achieved which reduces the influence of the transmission system by the hybrid and receiver.

Shown in a somewhat simplified way, the bridgeable distance is shortened for the transmission path with the same antenna and the same energy requirement but increased bandwidth. The antenna could however be made more efficiently, but this is typically only guaranteed by increasing the antenna volume. One possibility of improving the transmission path nevertheless consists in designing the antenna such that it uses a volume which would otherwise remain unused. Furthermore, the size of the antenna is increased and thus the efficiency is increased, without also having to create more space in the hearing instrument.

SUMMARY OF THE INVENTION

It is accordingly an object of the invention to provide a hearing instrument, in particular an ITE hearing instrument, and an antenna facility for a hearing instrument, which overcomes the above-mentioned and other disadvantages of the heretofore-known devices and methods of this general type and which provides for an improved data transmission system with respect to the transmission bandwidth with no or only an insignificantly greater space and energy requirement.

With the foregoing and other objects in view there is provided, in accordance with the invention, an antenna device for a hearing instrument, comprising:

an antenna arrangement with a coil core made of magnetically permeable material, the antenna arrangement having a preferred transmit and receive spatial direction;

a further electric hearing instrument component emitting electromagnetic interference radiation when in use;

a shield of magnetically permeable material disposed between the antenna arrangement and the further hearing instrument component, the shield being at least partially planar and being arranged transversely to the transmit and receive spatial direction of the antenna arrangement, and the shield being disposed at a spacing distance of 50 to 150 micrometers, preferably at a spacing distance of 75 to 100 micrometers, from the coil core of the antenna arrangement.

A basic idea behind the invention consists in an antenna device for a hearing instrument including an antenna arrangement with a coil core made of magnetically permeable material, which has a preferred transmit and receive spatial direction, and a further electric hearing instrument component, which emits electromagnetic interference radiation, wherein an at least partially flat shield made of magnetically permeable material is arranged between the antenna arrangement and the further hearing instrument component, and wherein the shield is arranged transverse to the transmit and receive spatial direction of the antenna arrangement at a distance of 50 to 150 micrometers relative to the coil core. The optimal distance results on the one hand such that with an increasing distance the signal-to-noise ratio-of, the antenna firstly increases and then decreases, with a maximum in the order of magnitude of 100 micrometers. On the other hand, the shield effect between the antenna and the further hearing instrument component initially increases with an increasing distance, and then evolves into saturation in the case of a distance of the order of magnitude of 100 micrometers. Furthermore, a minimal distance is to be retained on account of the overall installation size.

The term "transverse" is understood here to mean an orientation at right angles or approximately at right angles or in an angular range of a few degrees about 90° relative to one another. In this way, on account of different housing shapes, the design of which is determined by the auditory canal, a specific tilt can be permitted between the antenna and the shield, for instance in an angular range of 45° about the transverse orientation. In doing so a tilt relative to the transverse orientation disadvantageously reduces the sensitivity of the antenna.

The orientation relates here to the longitudinal axis of the antenna arrangement and the surface provided by the shield. The shield can either be a plate, or a U-shaped angular plate, or a type of bowl, into which the further hearing instrument component can be placed. The planar shield effects on the one hand a shielding of the electromagnetic fields and already as a result reduces the mutual interference coupling. A high magnetic permeability increases the shielding effect. Furthermore, the shield, on account of the high permeability of the material, ultimately brings about an extension of the antenna or an increase in its efficiency. A higher transmit field strength and a higher receive sensitivity develop as a result.

An advantageous development of the basic idea consists in the material of the coil core having a lower magnetic permeability than the material of the shield. The higher magnetic permeability of the shield material amplifies the shield effect, without, on account of the typically higher loss angle of the highly permeable material, having a notable negative effect on the performance of the antenna.

A further advantageous development of the basic idea consists in the shield consisting of mu-metal film. The use of a conventional mu-metal film with its particularly high magnetic permeability can achieve good processability at the same time as particularly good shielding.

A further advantageous development of the basic idea consists in the shield being glued to the antenna arrangement. This provides for a particularly uncomplicated assembly.

A further advantageous development of the basic idea consists in the further electric hearing instrument components mainly emitting the electromagnetic interference radiation in an interference radiation spatial direction, and in the antenna arrangement and the further hearing instrument component of being arranged transverse relative to one another such that coupling of interference radiation into the antenna arrangement is reduced. Mainly means that the radiation intensity of the interference radiation in the interference radiation spatial direction is greater than in any other spatial direction. The smallest coupling is produced if the two spatial directions are oriented at right angles to one another, such that by transverse is meant an orientation at right angles or approximately at right angles or in an angular range of a maximum of 45° greater or less than 90° relative to one another.

The orientation relates in more precise terms to the respective magnetic field, so that the respective fields are orientated transverse to one another and the respective magnetic fields likewise. In this way the main directions of the fields cannot be readily theoretically determined, so that the respective main direction is not clearly fixed. Furthermore, a minimal tilt relative to the transverse orientation on account of the thus caused asymmetry of the fields can have an advantageous effect on the shielding between the component and antenna. The optimal orientation of the component results, theoretically in this respect, at 90° but must however be determined individually depending on the component and its actual field. A tilting of the component basically has a less disadvantageous or even advantageous effect in comparison with a tilting of the shield, so that larger tilts of the component would generally be provided irrespective of the shield.

The reduction in the interference couplings into the antenna arrangement enables a greater transmit and receive bandwidth while retaining the structural volume and energy requirement. The further hearing instrument component may be a receiver or any other component emitting in particular inductive or electromagnetic radiation.

An advantageous development of the basic idea consists in the antenna arrangement including a coil antenna, in the further hearing instrument component including a coil arrangement which emits the interference radiation, and in the coil antenna and the coil arrangement being oriented transverse to one another with respect to their respective longitudinal direction, in other words at right angles or approximately at right angles, or in an angular range about 90°. The magnetic field of a coil antenna has a distinct spatial orientation, so that a distinct reduction in the mutual interference coupling is achieved by the alignment transverse to one another.

A further advantageous development consists in the further hearing instrument component being arranged on the shield. The arrangement of the hearing instrument component close to the antenna arrangement with a reasonably low mutual interference coupling is enabled in particular by the mutual shielding. A space-saving arrangement is produced as a result, which is furthermore also suited for preassembly of the antenna arrangement and the further hearing instrument component.

A further advantageous development consists in the further hearing instrument component being fastened on the shield. The fastening of the hearing instrument component on the shield forms a preassembled module together with the antenna arrangement. The further assembly or manufacture of the hearing instrument is simplified as a result.

A further advantageous development consists in the shield, at least in an area of its periphery, surrounding the further hearing instrument component in the direction facing away from the antenna core. The efficiency of the shield is as a result further increased and the interference coupling in particular of the further component into the antenna arrangement is further reduced. Furthermore, the sensitivity and the quality of the antenna increase as a result.

A further advantageous development consists in the further hearing instrument component being a receiver and the coil core and the shield having a sound channel which passes through the coil antenna. In the case of an ITE hearing instrument, both components can thus be positioned in a space-saving manner as deeply as possible in the auditory canal. An acoustically advantageous positioning of the receiver as close as possible to the eardrum is achieved, while the coil antenna close to the ITE hearing instrument of the respective other (right or left) ear of the user is achieved, thereby positively influencing the quality of the mutual data transmission. It has been shown practically that the sound channel does not significantly impair the antenna properties in the relevant field strength range.

The receiver is an electrodynamic converter and thus the receiver contains a magnetic circuit which has an excitation winding. During operation, the receiver is typically fed with a pulse-density-modulated signal, which has spectral components in the frequency band of the data transmission system. This actuation is very energy-efficient and is therefore used in hearing instruments. The spectral components cannot be avoided without strongly increasing the energy requirement of the hearing instrument. The receiver is the largest consumer in the hearing instrument. Contrary to this, the energy requirement of the data transmission system is to this end very small and accordingly its receive sensitivity relative to magnetic interferers is relatively large.

By arranging the receiver transverse to the antenna, the magnetic circuit and thus also the receiver winding is aligned at right angles or approximately at right angles or in an angular range about 90° relative to the antenna. The coupling of the receiver winding to the antenna is thus significantly reduced. The antenna can as a result be positioned significantly closer to the receiver.

The combination of the transverse-lying receiver with the antenna is optimized for the tapering shell contour at the tip of the ITE hearing instrument and the installation length is thus minimized. The positioning at the tip of the ITE hearing instrument increases the adjustment rate and reduces the size of the hearing instrument. In addition, more degrees of freedom are enabled when positioning the faceplate, since the antenna is no longer arranged on or close to the faceplate. Furthermore, the effort involved in planning a suitable position of the antenna on or close to the faceplate is omitted, since the tip of the ITE hearing instrument represents a position which was predetermined in advance. In this way there is also no need to take physical restrictions into account, e.g. of magnetic field interferences, which is required when positioning in the region of the faceplate.

Since the receiver winding is not arranged centrally with respect to the receiver, which is usually not possible in terms of structure, and since the housing slightly deforms the field lines, an interference coupling is still produced in the event of very close proximity to the antenna. The interference coupling on the antenna can be reduced by the additional shielding between the antenna and the receiver. The shielding preferably covers (best space/performance ratio) the entire surface of the receiver. The field lines of the excitation winding of the receiver are fed back in a concentrated manner on account of the shield arranged in the immediate proximity at a minimal distance from the antenna core, so that only a very small number of field lines passes through the antenna windings. This prevents current from being induced into the antenna winding and thus interference couplings from the receiver are significantly reduced. The shielding renders additional measures, for instance shielding films, and their installation, unnecessary.

The combination of shield and coil core is not only used for shielding purposes, but also in addition increases the sensitivity of the antenna. On account of the effect of the shield, the antenna length could therefore be reduced while retaining the same sensitivity.

A further advantage of the shield in the joint arrangement with the antenna is that with the same inductance, the required winding rate can be reduced so that in turn the diameter of the individual winding, typically enameled copper wire, can be increased. The minimal winding rate and the larger wire diameter advantageously reduce the electrical winding resistance, as a result of which the antenna quality is increased.

In order to increase the interference decoupling, the shield can also further extend around the edges of the receiver. All four edges of the receiver and their permutations are conceivable herefor and bring about a more or less large intensification of the decoupling effect. The receiver could be encased laterally or even entirely in order to further improve the shield effect. The antenna sensitivity and quality are herewith also further improved.

The field line concentration and thus the field strength of the antenna reduce on account of the shield at the exit to the receiver. The minimal field strength causes fewer eddy currents in the metal surface of the receiver, and the quality of the antenna increases as a result. The distance between the antenna and the receiver can therefore be shortened while retaining the same quality. This effect intensifies further on account of the hole in the ferrite, since the field lines concentrate at the edge in the flange area.

A further advantageous development of the basic idea consists in the coil core having a sound channel and the shield having a sound opening, and in the sound channel and the sound opening being arranged aligned with each other such that a continuous sound channel is formed. The sound channel enables in particular a receiver to be provided as a further hearing instrument component. The acoustic output signal of the receiver can then be routed directly into the sound channel. The acoustic output signal of a receiver arranged at another site can naturally also be routed through the sound channel if the further hearing instrument component is not a receiver. It is as a result particularly unnecessary to provide a separate sound channel, so that a further space requirement is avoided.

A further advantageous development consists in the inner wall of the sound channel and/or the side of the shield facing away from the coil core being covered with sound-damping material. The sound damping effects a vibration decoupling which is advantageous for the use of the receiver. By the sound damping being integrated into the module comprising coil core, coil antenna and receiver, a continuous preassembly and thus a continuous simplification of the further assembly and manufacture of the hearing instrument is achieved. Furthermore, the distance, which is effected by the sound damping between the receiver and the shield, provides for decoupling of shield and receiver at a distance which is required in order to increase the antenna quality, by the transfer of the antenna field into the receiver being reduced by the distance. In this way, the more the receiver is surrounded by the shield, the smaller the distance can be selected, without a reduction occurring in the antenna quality.

As explained previously, a basic idea behind the invention consists in configuring the antenna such that it can be positioned closer to a further hearing instrument component, without losing out on performance by this. To this end, an antenna device is specified, which integrates the different functions, for instance shielding, contacting etc. in a small space. The arrangement makes it possible in particular to manage without an additional space requirement and without additional components.

Furthermore, the antenna can also be positioned very close to the hearing instrument component, and combined as an integrated module. The installation is simplified as a result. The arrangement of the receiver relative to the antenna is fixedly predetermined and only one, instead of two, components is present. No separate work steps are required for the mounting of the antenna. Nor are any additional components required for a separate assembly. Instead, the antenna module is a part which is already automatically pre-assembled prior to manufacture.

Other features which are considered as characteristic for the invention are set forth in the appended claims.

Although the invention is illustrated and described herein as embodied in a antenna device for hearing instruments, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
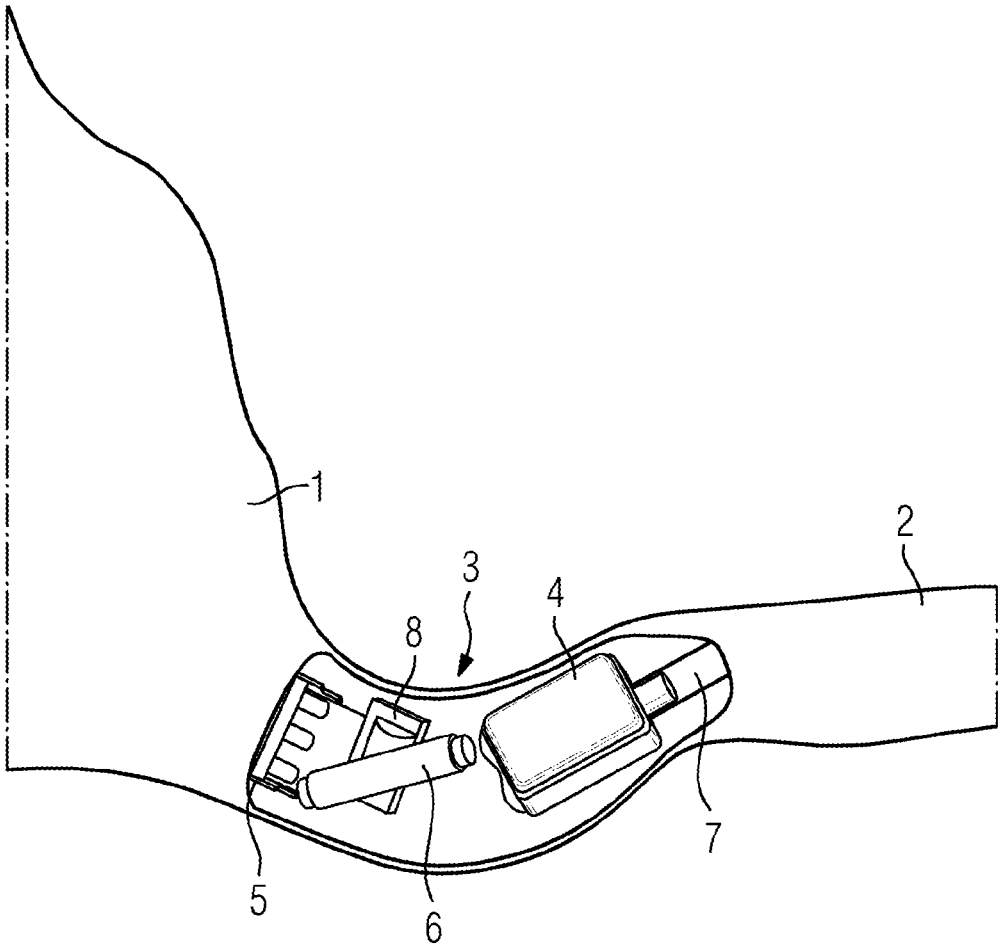
FIG. 1 is an illustration of a prior art ITE hearing instrument.

Referring now to the figures of the drawing in detail and first, particularly, to FIG. 1 thereof, there is shown a schematic representation of an ITE hearing instrument according to the prior art. The ITE hearing instrument 3 is inserted into the outer auditory canal of the hearing instrument wearer. It is partly disposed in the outer-lying cartilaginous part 1 of the auditory canal and is partially pushed into the bony part 2 of the auditory canal. This is consequently a CIC hearing instrument. Depending on how far the hearing instrument is introduced into the auditory canal, it could also be a deep-fit hearing instrument.

A receiver 4 is placed on the end oriented toward the eardrum in the hearing instrument 3. This outputs acoustic signals to the eardrum via a sound channel 7. A hybrid circuit substrate 8 is arranged on the faceplate arranged on the opposing end, said circuit substrate including a signal processing facility (not shown) and an amplifier for generating control signals for the receiver 4. An antenna 6 is likewise arranged and aligned on the faceplate 5 such that it is oriented in the direction of the opposing ear (not shown) of the hearing instrument wearer. The antenna 6 is used to transmit data between the two binaural hearing instruments of the hearing instrument wearer, wherein only one of the two hearing instruments is shown.

It is apparent that the antenna is arranged relatively close to the further electronic components of the hearing instrument 3, so that electromagnetic interference signals herefrom can be coupled into the antenna 6. Interference signals of this type are in particular emitted by the receiver 4, which has an inductive receiver coil, which is used to convert electrical signals into acoustic signals.

In addition, the signals which the antenna 6 sends or receives must pass the receiver 4 on their way to the opposing ear or hearing instrument of the hearing instrument wearer, which also negatively influences the data transmission path. The cited interference factors severely reduce the performance of the data transmission system, so that a high bandwidth can only be achieved to a restricted degree with at the same time a minimal energy requirement.

Figure 2:
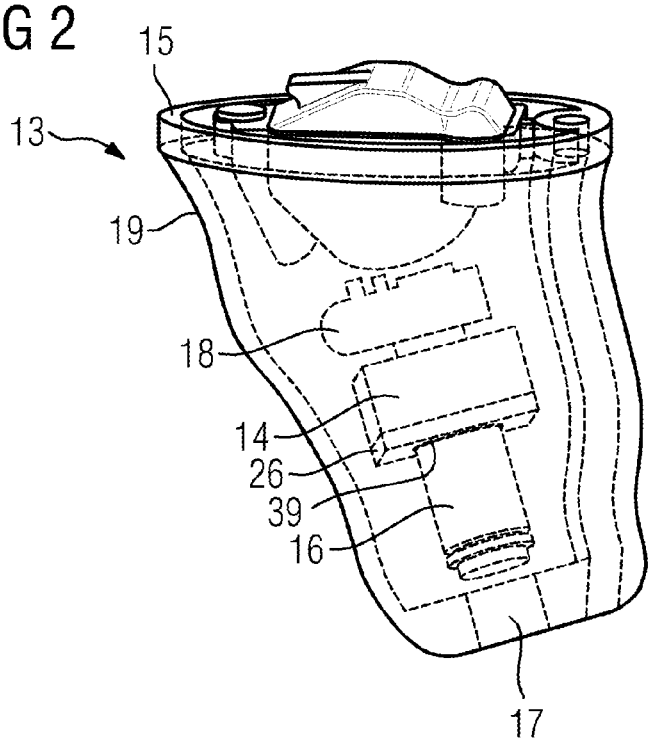
FIG. 2 shows an ITE hearing instrument with an antenna device according to the invention.

FIG. 2 shows a schematic view of an ITE hearing instrument with an antenna device. The housing 19 of the ITE hearing instrument 13 tapers on the side supporting the eardrum. A sound channel 17 on this side is used to emit acoustic signals toward the eardrum of the wearer.

The hearing instrument 13 is sealed by a faceplate 15 on the opposing side, on which faceplate, in addition to a battery (not shown) and microphones (likewise not shown), a hybrid circuit substrate 18 (shown with a dashed line) is arranged in the inside of the hearing instrument 13 or of its housing 19. The hybrid circuit substrate 18 includes a signal processing facility and an amplification facility, which actuates the receiver 14 which is likewise arranged inside the housing 19. The receiver 14 generates acoustic output signals, which are output by way of the sound channel 17.

The receiver 14 is oriented transversely to the longitudinal axis of the hearing instrument 13. The antenna 16 is disposed between the receiver 14 and the tapered end of the hearing instrument 13 oriented toward the eardrum, in order to transmit data between the two binaural hearing instruments of the hearing instrument wearer. The antenna 16 is oriented in the longitudinal direction of the hearing instrument 13 and is thus aligned transversely to the receiver 14. It is separated from the receiver 14 by a shield 26. The shield is arranged transverse to the antenna 16 and at a minimal distance from its coil core (not shown). It has a sound opening 39, which is arranged flush with the sound channel 17. The distance amounts to between 50 and 150 micrometers.

The transverse alignment of the receiver 14 effects a space-saving arrangement of the receiver 14 and antenna 16, the overall length of which is reduced by the transverse arrangement of the receiver 14. In addition, the transverse arrangement of the receiver 14 produces an improved utilization of space in the tapering part of the housing 19. The space available in the tapered tip of the housing 19 is utilized better than would be the case with a longitudinally arranged receiver. In the event that the sound output of the housing 19 does not follow a straight line with the sound channel 17 in the antenna 16, then a curved pre-formed sound tube which leads to the sound exit is connected to the antenna 16 on the output side.

Figure 3:
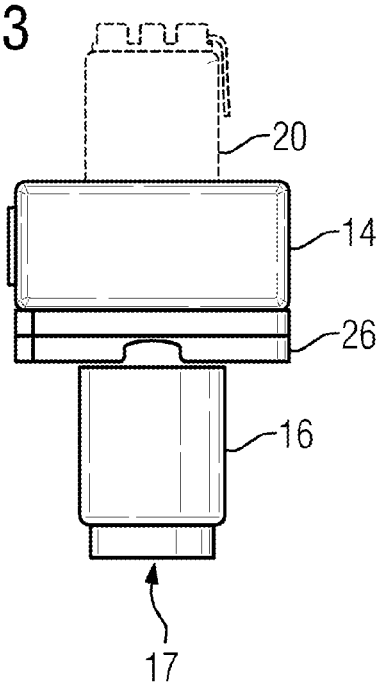
FIG. 3 shows a schematic representation of the antenna device.

FIG. 3 again shows a schematic representation of the antenna device. The sound channel 17 is disposed within the antenna 16 and runs through the antenna to the receiver 14. The receiver 14 is, as explained above, oriented transversely to the antenna 16 and to the longitudinal direction of the ITE hearing instrument. The shield 26 is arranged between the coil core (not shown) of the antenna 16 and the receiver 14 at a distance of 50 to 150 micrometers from the coil core. The distance can be effected for instance by a premolded part, upon which the shield 26 and the antenna 16 are mounted. The distance can also be effected in a particularly simple manner in that the shield 26 and antenna 16 are glued to one another by means of an adhesive layer of a suitable thickness.

A longitudinally arranged receiver 20 is shown with a dashed line for explanation purposes only. The dashed arrangement of the receiver 20 illustrates that the overall length increases with a longitudinal arrangement of the receiver 20, thereby not at the same time producing a tapering contour of the arrangement. As explained previously, it is illustrated such that with a longitudinal arrangement of the receiver 20, the space cannot be utilized so well in the tapered tip of the hearing instrument 13.

Figure 4:
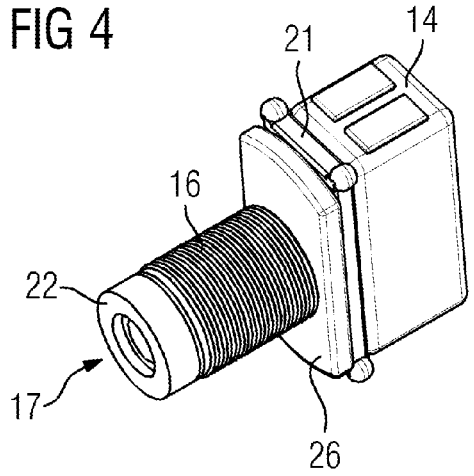
FIG. 4 shows the antenna receiver module.

FIG. 4 shows a perspective view of an antenna receiver module. The receiver 14 is, as explained previously, oriented transversely to the antenna 16. The antenna 16 is arranged on a coil core 22 which consists of permeable material. The permeable coil core 22 is used, in a conventional manner, to increase the antenna surface or sensitivity.

The shield 26 is arranged (the distance is not recognizable in the figure) at a distance of 50 to 150 micrometers from the end of the coil core 22 facing toward the receiver 14. The shield 26 is predominantly planar in shape and oriented transversely to the alignment of the antenna 16, in other words in parallel to the alignment of the receiver 14. The surface of the shield 26 is dimensioned such that the receiver 14 is entirely or almost entirely shielded from the antenna across the entire surface facing the shield 26 by means of the shield 26, or conversely the antenna 16 is shielded from the receiver 14.

The sound channel 17 runs through the coil core 22 and through the shield 26 to the receiver 14. The coil core 22 is covered on the inside by a sound-damping or vibration-damping material which is molded as a tube 21 (cf. FIG. 9). In an alternative embodiment, the coil core 22 does not need to be covered in a vibration-damping manner on the inside and would then be used as a per se undamped sound guidance. A larger cross-section of the sound tube can thus be achieved. The tube 21 surrounds the sound channel 17 from the antenna-side exit toward the receiver 14 and is molded there in a planar fashion in parallel to the shield 26. The receiver 14 is attached to the planar-shaped part of the tube 21 and is thus likewise vibration-insulated. Round extensions of the sound- or vibration-damping material are used for the vibration-decoupled suspension of the facility in the housing of the hearing instrument, said facility also being integrated into the facility.

The coil core 22 forms an antenna receiver module, together with the tube 21, the antenna 16, the shield 26, and the receiver 14. The tube 21 can be molded such that with arrangements of the shield 26 and the coil core 22 on the tube 21, the distance mentioned above results between the shield 26 and the coil core 22. The module can be inserted into the hearing instrument pre-installed or pre-assembled. The pre-assembly of the antenna receiver module on the tube 21 reduces the assembly outlay during manufacture of the hearing instrument and thus simplifies the manufacturing process.

Figure 5:
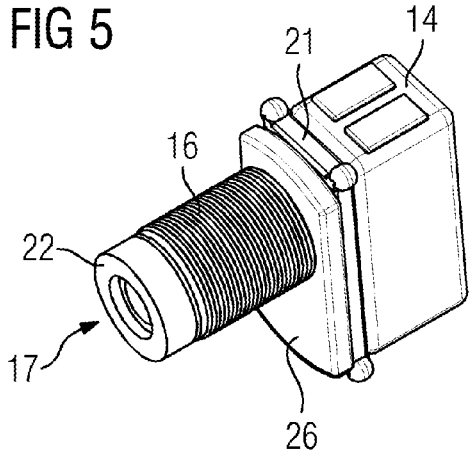
FIG. 5 shows the antenna receiver module with an offset antenna.

FIG. 5 shows an embodiment similar to the preceding representation of FIG. 4. In this respect, the same reference characters are used for the same components and reference is made to the preceding explanations. Contrary to the embodiment mentioned above, the coil core 22 and antenna 16 is however not arranged centrally with respect to the shield 26, but is displaced (upward in the figure). This can be used to adjust the outer shape of the antenna 16 and receiver 14 to the assembly space available in a hearing instrument.

Figure 6:
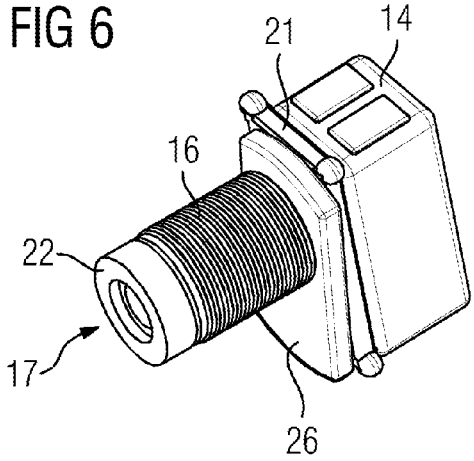
FIG. 6 shows the antenna receiver module with a tilted receiver.

FIG. 6 shows a further embodiment similar to the preceding representations. The same reference characters are in turn used and reference is made to the preceding explanations. Contrary to the embodiment mentioned previously, the receiver 14 is tilted relative to the shield 26. This can also be used for adjustment to the assembly space available in a hearing instrument. Depending on the alignment of the dynamic fields of the receiver 14 and antenna 16, the shielding effect of the shield 26 can vary with a minimal tilting angle of the receiver 14, and in certain circumstances can even be improved compared with an exactly perpendicular arrangement.

Figure 7:
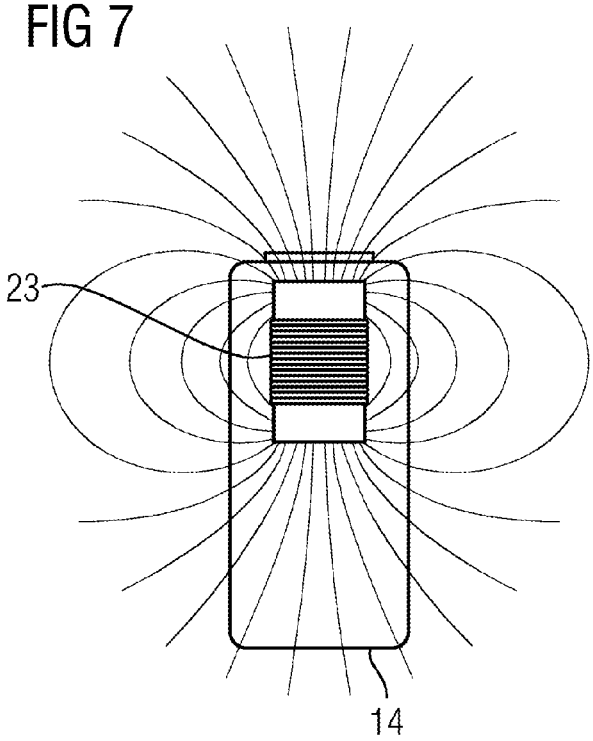
FIG. 7 is a field line diagram of the receiver.

FIG. 7 shows a schematic and significantly simplified representation of the field line diagram of a receiver functioning with receiver coils. A receiver coil 23 is arranged axially in the receiver 14, in other words oriented in the longitudinal direction. It is apparent that the receiver coil 23 in the axial direction generates a very compressed (magnetic) field, while in the radial direction, in the figure in other words to the right and left, generates a relatively weak (magnetic) field. The field of the receiver 23 is generally however significantly influenced by its housing and possibly one or more further receiver coils and magnetic components and is formed in a more complex manner.

It is also apparent that the magnetic field, which the receiver 14 generates, is more strongly pronounced in its longitudinal direction than in its transverse direction. Consequently, the previously mentioned arrangement, in which the antenna which is sensitive to electromagnetic interference signals is not arranged longitudinally but instead transversely to the receiver, already brings about a significant decoupling of the electromagnetic signals of the receiver 14 from the said antenna. The improved decoupling is thus achieved in that the antenna is arranged both laterally from and also transverse to the receiver 14.

Figure 8:
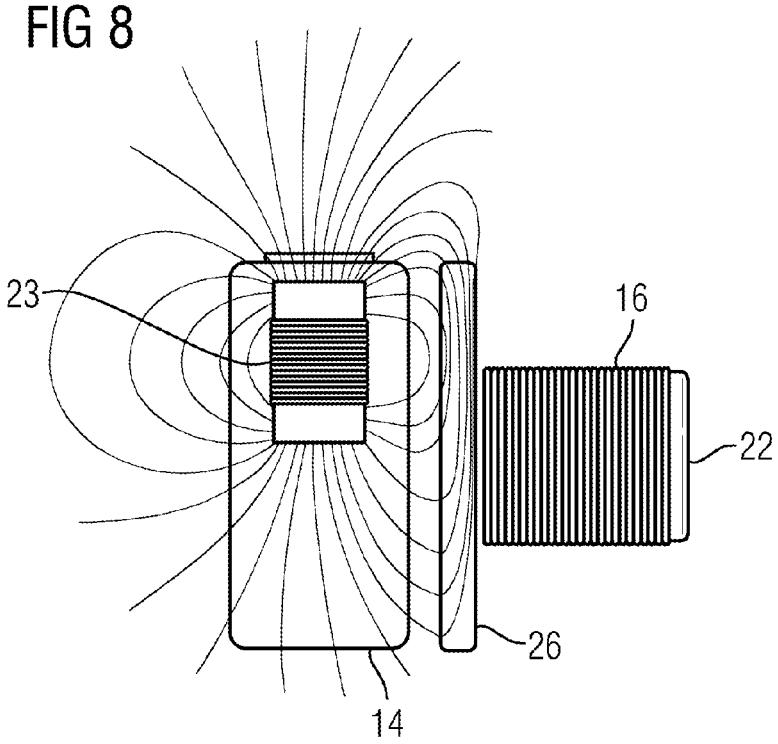
FIG. 8 shows the field line distribution of the receiver with shielding.

FIG. 8 shows the field line diagram of the receiver with a shielding. The receiver 14 is arranged to the left in the figure on the previously cited shield 26 of the permeable coil core 22. On the other side of the shield 26, the slightly spaced-apart coil core 22 explained above bears the antenna 16.

The field line diagram shown illustrates the shielding of the antenna 16 from the receiver 14 or from the signals of the receiver coil 23. The field lines running in the direction of the antenna 16 are deformed by the shield 26 and run herethrough. The field line density in the shield 26 is thus increased, whereas the field line density on the other side of the shield 26 is as a result reduced at the same time. In other words, the strength of the (magnetic) field generated by the receiver coil 23 at the site of the coil 16 is reduced significantly. Interference couplings from receiver signals into the antenna 16 are thus significantly reduced.

Figure 9:
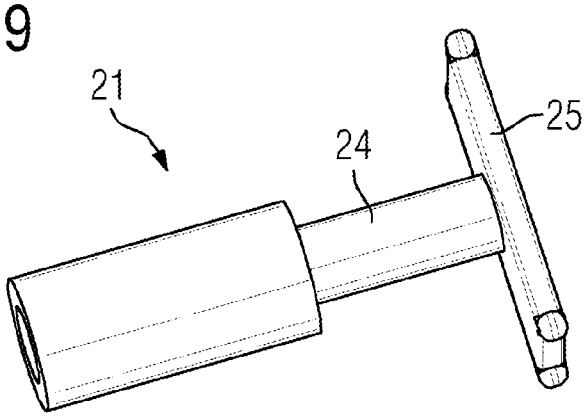
FIG. 9 shows a tube.

FIG. 9 shows the previously mentioned sound-damping tube separately. A sound channel traverses the tube 21 in the longitudinal direction. A coil section 24 is provided to receive the previously mentioned coil core 22. The coil core 22 is arranged around the coil section 24, if necessary also around the further longitudinal path of the tube 21. A shield section 25 is provided to receive the shield. The shield is placed here on the one side of the shielding section 25, whereas a receiver is arranged on the opposite side of the shield section 25. The illustrated tube 21 consists entirely of sound-damping material, for instance conventionally of a synthetic rubber such as Viton®.

Figure 10:
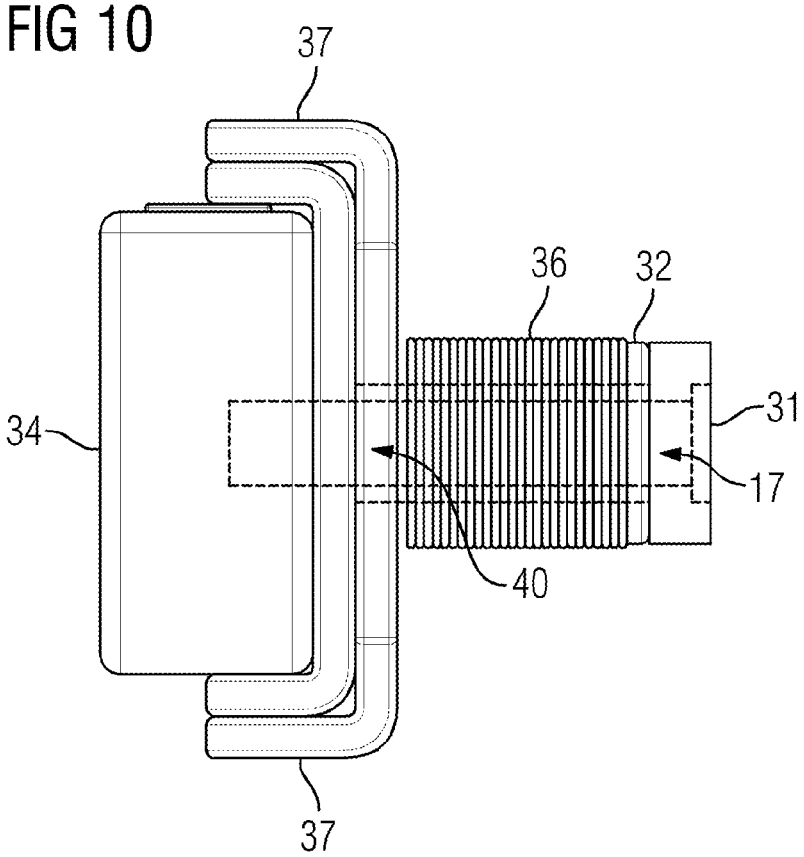
FIG. 10 shows the antenna receiver module.

FIG. 10 shows a further embodiment of the antenna-receiver module. At a distance of 50 to 150 micrometers from the coil core 32, a shield 37 is arranged, as explained above, on one side. An antenna 36 is wound onto the coil core 32. On the side facing away from the antenna 36, the shield 37 surrounds the receiver 34 arranged there at least in the region shown to the top and bottom in the figure. To this end, the shield 37 is embodied there in the shape of a bowl, so that the receiver 34 is surrounded by the shield 37 at least in a region of the shield periphery in the direction facing away from the antenna 36.

A particularly good shielding is then produced if the shield 37 surrounds the receiver 34 on all sides. A further improvement in the shielding can be achieved in that the shield 37 entirely encloses the receiver 34 and not just laterally. A further improvement in the antenna is produced as a result, which can either be used to increase the bandwidth or else to perform a shortening of the antenna with unvarying performance.

A sound channel 17 passes through the coil core 32, and thanks to the continuous tube 31 is covered with sound-damping material. The sound channel 17 is arranged flush with the sound opening 40 of the shield 37. The sound opening 40 and the sound channel 17 thus together form a continuous sound channel. The tube 31 is likewise embodied planar or bowl-shaped in the region of the shield 37 and receives the receiver 34 in a vibration-damping manner. The receiver 34 is attached to the tube 31. The receiver antenna module shown can be pre-assembled, so that the further assembly and manufacture of the hearing instrument is significantly simplified.

Figure 11:
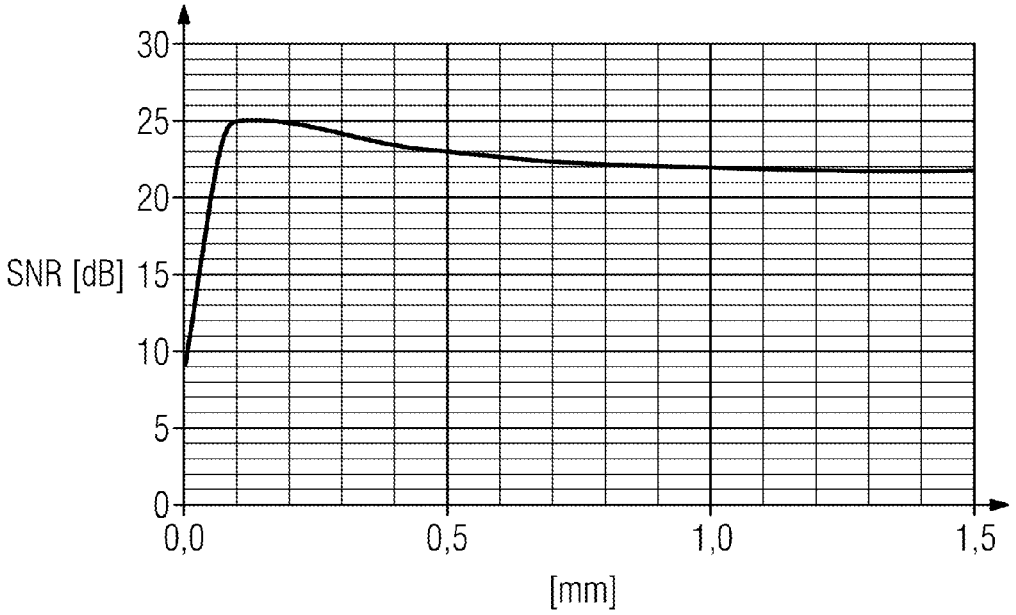
FIG. 11 is a diagram plotting the signal-to-noise ratio across the shielding distance.

FIG. 11 shows the curve of the signal-to-noise ratio (SNR) of the antenna signal as a function of the distance explained above between the shield and the coil core of the antenna. It is apparent that the signal-to-noise ratio is at its maximum at approximately 100 to 200 micrometers distance. It emerges from the curve that a certain minimum distance between the shield and coil core is advantageous.

Figure 12:
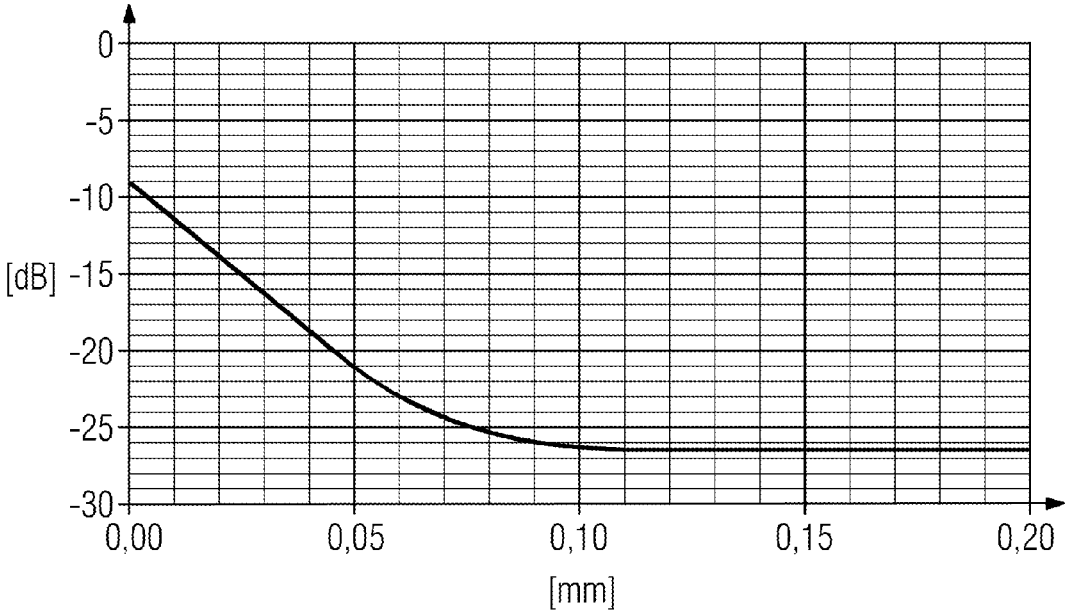
FIG. 12 is a diagram illustrating the interference signal damping across the shielding distance.

FIG. 12 shows the damping of the interference signals of the receiver for the antenna signal as a function of the distance explained above between the shield and the coil core of the antenna. It is apparent that the damping at approximately 100 micrometers distance converges into a maximum damping. It emerges from the curve that a certain minimum distance between the shield and coil core is advantageous.

From the synopsis of the afore-cited diagrams (signal-to-noise ratio over distance, interference signal-damping over distance) it has been shown that a certain minimal distance (approx. almost 100 micrometers) between the shield and the coil core is advantageous, but that this advantage does not increase further or even reduces again with increasing distance as from a certain further distance (approx. 200 micrometers). The drive to achieve the smallest possible structure of the antenna-receiver arrangement militates against a further increase in the distance.

From the considerations mentioned above, a distance of approximately 50 to 150 micrometers between the shield and the coil core emerges as advantageous for antenna properties and installation size. It is further apparent from the diagrams that the narrower range of approx. 75 to 100 micrometers is particularly advantageous. It is apparent that according to the individual design of antenna, coil core, shield and receiver, other values may result. In constellations which are typical of hearing instruments, it is however assumed that these move within the scope of the specified value ranges.

Figure 13:
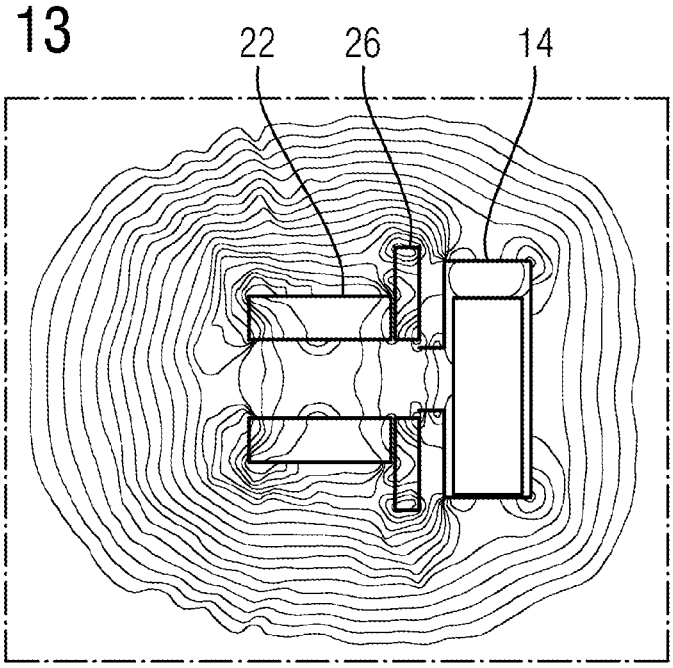
FIG. 13 illustrates the field lines of the antenna field.

FIG. 13 shows a schematic representation of the magnetic field of the antenna in and around the coil core 22. Because the shield 26 is spaced apart from the coil core 22 it can be readily observed that it brings about a compression of the magnetic field on the side of the coil core 22 or antenna. On account of for its part permeable properties of the receiver 14, part of the magnetic field is also guided herethrough, which advantageously even brings about a theoretical extension of the antenna and thus contributes to improving the sensitivity.

It is not shown in the figure that the deformation of the field line curve by the shield 26 results in the field lines overall together running longer in the coil core 22 and shield 26. As a result, there is an advantageous increase in sensitivity. It is also apparent that a reduction in the field lines coming from the antenna develops between the shield 26 and receiver 14, because the field lines exit more strongly at the edge of the shield 26 and not somewhere between the shield 26 and receiver 14. At the same time, the shield does not have a disadvantageous effect on the scatter field.

Figure 14:
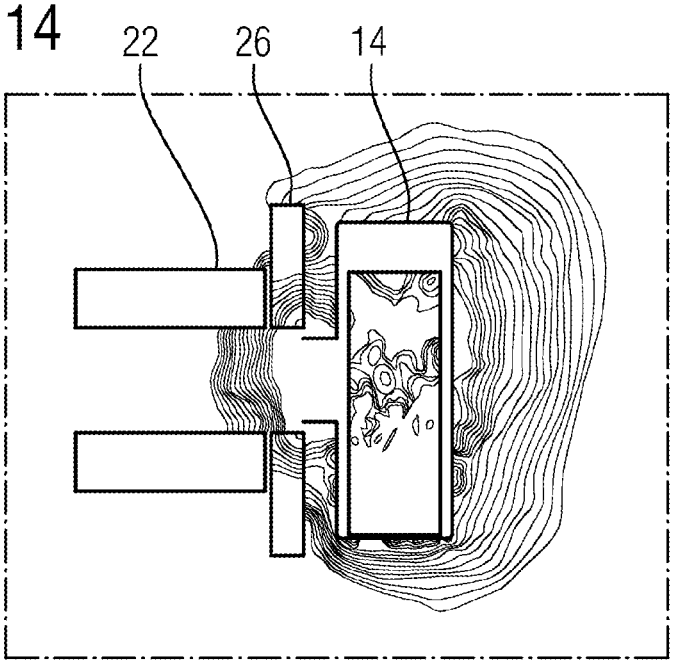
FIG. 14 illustrates the field lines of the receiver field.

FIG. 14 shows a schematic representation of the magnetic field of the receiver 14. Because the shield 26 is spaced apart from the coil core 22 it can be readily observed that it brings about a shielding of the magnetic field of the receiver 14 for the antenna or the coil core 22. It is apparent that although part of the magnetic field penetrates into the shield 26, only the smallest part thereof reaches the coil core 22 across the gap.

The field lines running in the direction of the antenna 16 are deformed by the shield 26 and run herethrough. The field line density in the shield 26 is thus increased, whereas the field line density on the other side of the shield 26 is as a result reduced at the same time. In other words, the strength of the (magnetic) field generated by the receiver coil at the site of the coil is significant. Interference couplings from receiver signals into the antenna are thus significantly reduced.

Simulations have shown that although the field of the receiver 14 can assume a very different design over time, the good shielding effect is however essentially always kept constant.

Once more in summary: The invention relates to an antenna device for hearing instruments, in particular for hearing instruments to be worn in the auditory canal. The object of the invention is to specify a hearing instrument, in particular ITE hearing instrument, which specifies an improved data transmission system with respect to the transmission bandwidth with no or only an insignificantly increased space and energy requirement. A basic idea behind the invention consists in an antenna device for a hearing instrument including an antenna arrangement with a coil core made of magnetically permeable material, which has a preferred transmit and receive spatial direction, and a further electric hearing instrument component, which emits electromagnetic interference radiation, wherein an at least partially flat shield made of magnetically permeable material is arranged between the antenna arrangement and the further hearing instrument component, and wherein the shield is arranged transverse to the transmit and receive spatial direction of the antenna arrangement at a distance of 50 to 150 micrometers relative to the coil core. The optimal distance results on the one hand from the fact that with an increasing distance the signal-to-noise ratio of the antenna firstly increases and then reduces, with a maximum in the order of magnitude of 100 micrometers. On the other hand, the shield effect between antenna and further hearing instrument component initially increases with an increasing distance in order then to pass into saturation in the case of a distance of the order of magnitude of 100 micrometers. Furthermore, a minimal distance is to be retained on account of the overall installation size.

The invention claimed is:

1. An antenna device for a hearing instrument, comprising:

an antenna arrangement with a coil core made of magnetically permeable material, said antenna arrangement having a preferred transmit and receive spatial direction;

a further electric hearing instrument component emitting electromagnetic interference radiation when in use;

a shield of magnetically permeable material disposed between said antenna arrangement and said further hearing instrument component, said shield being at least partially planar and being arranged transversely to the transmit and receive spatial direction of said antenna arrangement, and said shield being disposed at a spacing distance of 50 to 150 micrometers from said coil core of said antenna arrangement.

2. The antenna device according to claim 1, wherein said spacing distance amounts to 75 to 100 micrometers.

3. The antenna device according to claim 1, wherein the magnetically permeable material of said coil core has a lower magnetic permeability than the magnetically permeable material of said shield.

4. The antenna device according to claim 2, wherein said shield is a foil made of mu-metal.

5. The antenna device according to claim 1, wherein said shield is glued to said antenna arrangement.

6. The antenna device according to claim 1, wherein said further electric hearing instrument component is configured to mainly emit the electromagnetic interference radiation in an interference radiation spatial direction, and wherein said antenna arrangement and said further hearing instrument component are arranged transversely relative to one another to thereby reduce a coupling of interference radiation into said antenna arrangement.

7. The antenna device according to claim 1, wherein said antenna arrangement comprises a coil antenna defining a first longitudinal direction, said further hearing instrument component comprises a coil arrangement configured to emit the interference radiation and defining a second longitudinal direction, and wherein said first and second longitudinal directions of said coil antenna and said coil arrangement are oriented transversely to one another.

8. The antenna device according to claim 1, wherein said further hearing instrument component is arranged on said shield.

9. The antenna device according to claim 8, wherein said further hearing instrument component is affixed to said shield.

10. The antenna device according to claim 1, wherein said shield, at least at a periphery thereof, surrounds said further hearing instrument component in a direction facing away from said antenna arrangement.

11. The antenna device according to claim 1, wherein said coil core has a sound channel formed therein and said shield has a sound opening formed therein, and wherein said sound channel and said sound opening are arranged flush relative to one another so as to form a continuous sound channel.

12. The antenna device according to claim 11, which comprises sound-damping material covering one or both of an inner wall of said sound channel and a side of said shield facing away from said coil core.

13. A hearing instrument, comprising an antenna device according to claim 1.

* * * * *